US008892343B2

(12) United States Patent
Gupta et al.

(10) Patent No.: US 8,892,343 B2
(45) Date of Patent: Nov. 18, 2014

(54) DETERMINING A SPATIOTEMPORAL IMPACT OF A PLANNED EVENT ON TRAFFIC

(75) Inventors: Chetan Kumar Gupta, San Mateo, CA (US); Sergey Serebryakov, Saint-Petersburg (RU); Maria G Castellanos, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 101 days.

(21) Appl. No.: 13/562,490

(22) Filed: Jul. 31, 2012

(65) Prior Publication Data

US 2014/0039782 A1 Feb. 6, 2014

(51) Int. Cl.
*G08G 1/052* (2006.01)
*G08G 1/01* (2006.01)

(52) U.S. Cl.
CPC ..... *G08G 1/0133* (2013.01); *G08G 1/052* (2013.01)
USPC ..... 701/117; 701/423

(58) Field of Classification Search
CPC ..... G08G 1/0133
USPC ..... 701/117–119, 414, 423; 340/995.13
See application file for complete search history.

(56) References Cited

U.S. PATENT DOCUMENTS 5,696,503 A * 12/1997 Nasburg ..... 340/933
6,542,808 B2 * 4/2003 Mintz ..... 701/117
6,574,548 B2 * 6/2003 DeKock et al. ..... 701/117
7,363,203 B2 * 4/2008 Hines ..... 703/2
7,609,172 B2 10/2009 Rozum et al.
7,636,630 B2 * 12/2009 Fushiki et al. ..... 701/423
7,698,055 B2 * 4/2010 Horvitz et al. ..... 701/117

(Continued)

FOREIGN PATENT DOCUMENTS

DE 102005055244 A1 * 5/2007 ..... G08G 1/01
JP 10283588 A * 10/1998 ..... G08G 1/09
JP 11316891 A * 11/1999 ..... G08G 1/00
JP 2011021997 A * 2/2011

OTHER PUBLICATIONS

Keppel, David, "Design and implementation of a traffic data engine and visualization interface for a mini traffic database management system", completed in CS 5614, Database Management Systems, Virginia Tech, Fall 2007, downloaded from http://filebox.vt.edu/users/dkeppel/CS5614/Keppel_Wyland_Mini-Traffic_Project.pdf.*

(Continued)

*Primary Examiner* — Behrang Badii
*Assistant Examiner* — David Testardi

(57) ABSTRACT

Systems and methods are provided for determining an impact of a planned event. Traffic flow velocity is measured at each of a plurality of traffic sensors over a period of time before the planned event, with each traffic sensor having an associated geographical location. A plurality of measured traffic flow velocities for each traffic sensor are stored on a non-transitory computer readable medium. A traffic flow velocity at each traffic sensor is measured at each of a plurality of representative times within a defined time period including a known start time and an expected end time of the event. A threshold velocity is calculated from the stored traffic flow velocities for each traffic sensor corresponding to each representative time. For each representative time, a set of traffic sensors is determined at which the measured traffic flow velocity during the defined time period is less than the threshold velocity.

14 Claims, 2 Drawing Sheets

(56) References Cited

U.S. PATENT DOCUMENTS

| | | | | |
|---|---|---|---|---|
| 7,734,410 | B2 * | 6/2010 | Tooyama et al. | 701/457 |
| 7,813,870 | B2 * | 10/2010 | Downs et al. | 701/117 |
| 7,912,628 | B2 * | 3/2011 | Chapman et al. | 701/117 |
| 8,090,524 | B2 | 1/2012 | Chapman et al. | |
| 2006/0058940 | A1 * | 3/2006 | Kumagai et al. | 701/117 |
| 2008/0319639 | A1 * | 12/2008 | Yamane | 701/118 |
| 2009/0082948 | A1 * | 3/2009 | Hiruta et al. | 701/117 |
| 2010/0070175 | A1 | 3/2010 | Soulchin et al. | |
| 2011/0106416 | A1 | 5/2011 | Scofield et al. | |
| 2011/0319099 | A1 * | 12/2011 | Beuk | 455/456.3 |
| 2013/0166188 | A1 * | 6/2013 | Zheng et al. | 701/117 |
| 2013/0253808 | A1 * | 9/2013 | He et al. | 701/117 |
| 2013/0289864 | A1 * | 10/2013 | Miller et al. | 701/119 |

OTHER PUBLICATIONS

Liu, Wei et al., "Discovering spatio-temporal causal interactions in traffic data streams", Proceedings of the 17th ACM SIGKDD International Conference on Knowledge Discovery and Data Mining, KDD'11, Aug. 21-24, 2011, San Diego, CA, 9 pages.*

Lund, Andrew S., "Dynamic wide-area congestion and incident monitoring using probe data", published in the Transportation Research Record, Transportation Research Board, Nov. 2009, 16 pages, downloaded from http://pressamp.trb.org/compendium/508/7ECE2C4D0406.pdf.*

Lu, Chang-Tien, "Towards advanced spatio-temporal visualization system for the metropolitan Washington D.C.", 5th International Visualization in Transportation Symposium and Workshop, Oct. 23-26, 2006, Denver, Colorado, downloaded from: http://www.teachamerica.com/VIZpdf/VIZ05b_Lu.pdf.*

Odawara, Yuichi, "Study on VICS data for road administration use", Google date: Dec. 2, 2006, 20 pages, downloaded from http://www.mlit.go.jp/road/ITS/conf/2006/ts20.pdf.*

Queen, Catriona M. et al., "Eliciting a directed acyclic graph for multivariate time series of vehicle counts in a traffic network", Australian and New Zealand Journal of Statistics, 49(3), pp. 221-239, copy downloaded from http://oro.open.ac.uk/17547/1/ANZJS-final.pdf.*

Queen, Catriona M. et al., "Forecasting traffic flows in road networks: a graphical dynamic model approach", Proceedings of the 28th International Symposium of Forecasting, International Institute of Forecasters, 2008, 24 pages.*

Yamane, Ken'ichiro et al., "Method of travel time estimation for wide-area traffic information service", Systems and Computers in Japan, vol. 36, No. 11, 2005, pp. 82-92.*

Queen, Catriona M. et al., "Eliciting a directed acyclic graph for multivariate time series of vehicle counts in a traffic network", Australian and New Zealand Journal of Statistics, 49(3), 2007, pp. 221-239, copy downloaded from http://oro.open.ac.uk/17547/1/ANZJS-final.pdf.*

"IBM Intelligent Transportation Product Documentation", Version 1, Release 0, 2012.

* cited by examiner

DETERMINING A SPATIOTEMPORAL IMPACT OF A PLANNED EVENT ON TRAFFIC

BACKGROUND

Traffic monitoring systems are used to collect real-time information showing current travel conditions on freeways and high occupancy roadways. This information can be used to detect and address acute or chronic traffic congestion. In some jurisdictions, real-time traffic monitoring data can be used to open additional lanes (e.g., such as hard shoulders not normally used for travel), notify drivers of alternate routes, or otherwise attempt to mitigate the effects of congestion.

DETAILED DESCRIPTION

Figure 1:
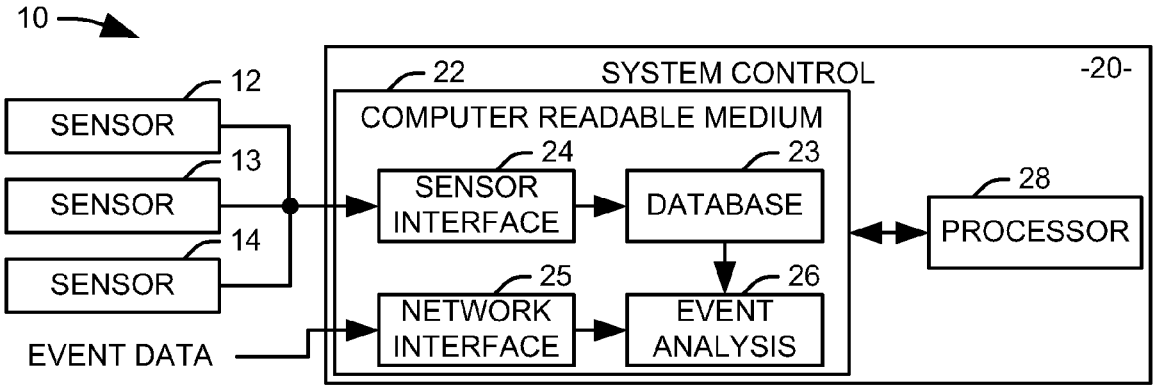
FIG. 1 illustrates one example of a traffic monitoring system to determine a spatiotemporal impact of a planned event on traffic flow.

Quantifying overall traffic flow velocity for traffic is a complex process because traffic typically contains a diverse number of vehicles traveling at various speeds changing with time and road conditions. Events likely to draw a large number of spectators or participants, such as concerts, sporting events, and holiday events can have a significant impact on traffic flow in a region surrounding the venue, causing it to deviate from expected norms. Many of these events either reoccur at the same venue, or are replaced within similar events at the same venue, and the inventors have determined that an understanding of the impact of these events, not only during the event, but in a time window extending before and after the event, can be used for predicting traffic flow.

To this end, a traffic monitoring system for determining a spatiotemporal extent of a planned event can include sensors linked to a computerized processing unit and configured to capture traffic data, including a flow rate, in vehicles per unit time, and an average velocity of the vehicles. The traffic data can be used to establish threshold traffic flow and velocities indicative of the normal course of traffic absent the planned event. These threshold velocities are then used as a baseline for identifying, for each of a plurality of representative times before, during, and after the event, the spatial extent of the effects on traffic congestion.

In more specific terms, the present examples of the system for identifying impact of a traffic incident on a road network may capture traffic data relating to individual vehicles by way of sensors at various representative times and render the traffic data into traffic-flow velocities representing the overall traffic-flow velocity at a specific data capture location and time, according to examples. The traffic-flow velocity may be derived from traffic data captured by sensors configured to capture traffic data such as the number of vehicles passing a sensor location during a known time period, a flow occupancy, or a vehicular velocity.

The spatiotemporal impact region is a dynamic region and may be defined by congested, contiguous sections of a road network. A congested state may be a condition in which the traffic-flow velocity determined from traffic data obtained at a specific data capture location and representative time is less than a threshold velocity associated with the same data capture location and capture time, according to historical examples. The threshold velocity for each sensor and data-capture time may be defined as a recurrent traffic-flow velocity determined from traffic data obtained during a dedicated training period preceding the planned event.

Additional definitions to be used throughout the document are as follows:

"Planned event" refers to any event having a venue, a start time that is known a priori, and an expected end time that is believed likely to have a measurable spatiotemporal impact on traffic.

"Recurrent traffic-flow velocity" refers to traffic-flow velocity associated with each sensor at representative times in a training period preceding the event.

"Congested state" refers to a road segment having a flow-averaged velocity less than a threshold or recurrent speed.

"Traffic-flow velocity", "v" at a data capture location "p" at time "t, or" v(p, t), refers to a flow-averaged velocity, which can be calculated as:

$$\frac{\sum_{k=1}^{N_l} q_k(p,t)v_k(p,t)}{\sum_{k=1}^{N_l} q_k(P,t)} \quad \text{Eq. 1}$$

wherein $q_k(p, t)$ is a flow rate for a lane, k, in units of vehicles per hour at a sensor, p, at each time, t, and $v_k(p, t)$ is a velocity for each lane at a sensor at each time. It will be appreciated that $v_k(p, t)$ is derived from induction loop detectors, but, vehicular velocities acquired by other means may be rendered into a flow averaged velocities by way of the above equation.

FIG. 1 illustrates one example of a traffic monitoring system 10 to determine a spatiotemporal impact of a planned event on traffic flow. The traffic monitoring system 10 includes a network of sensors 12-14. The term "sensor" is used generally herein to refer to the equipment used to capture traffic data at a given location. Therefore a sensor 12-14 can include one or multiple discrete devices associated with a given geographical location, including induction-loop sensors, cameras, radar units and location-tracked mobile units. Each sensor 12-14 has a data connection with a system control 20 to allow traffic flow and velocity data associated with a given location to be provided.

The system control 20 can be implemented as software or firmware instructions or as digital logic in dedicated hardware. In the illustrated example, the system control 20 includes a non-transitory computer readable medium 22 storing a database 23 of sensor metadata, historical traffic data, event information, some other data such as weather etc., and venue information, as well as machine readable instructions, indicated as functional blocks 24-26. A processor 28 associated with the system control can execute the machine readable instructions to perform the functions described herein.

A sensor interface 24 interacts with the sensors 12-14 over the data connection, such that each of gathered traffic data, metadata associated with the gathered data (e.g., time, date, and location at which the data was gathered, and a device status) is provided through the sensor interface and stored in the database 23. A network interface 25 can either receive from a user or actively retrieve from an associated service information concerning events, including a start time, one or both of a duration or end time, and a venue. The database 23 can include a list of venues within the spatial extent of the network of sensors 12-14 and their locations, such that a location of the event, expressed in one example as geospatial coordinates, can be retrieved.

An event analysis component 26 determines a geospatial extent of the impact of the event from the historical traffic data stored in the database 23 and traffic data captured in a time period encompassing the event. Initially, the event analysis component 26 retrieves the location of the event from the database 23 and determines a set of all sensors within a spatial region on which the event is likely to have an effect on traffic. In one implementation, this is accomplished by including all sensors within a user-defined threshold distance from the location of the venue. The event analysis component 26 can also determine an expected range of temporal impact from the event, based on the known (or expected) start time and end time of the event. In one example, a user-defined threshold time period, T, can be applied to each of the start time, $S_{begin}$, and the end time, $S_{end}$, such that a temporal region of interest is defined from $S_{begin}-T$ to $S_{end}+T$. It will be appreciated, however, that in other implementations, the temporal region can extend before and after the event by different amounts of time.

At each of a plurality of representative times within the defined temporal region, a threshold velocity is computer for every sensor 12-14 within the determined spatial region. The threshold velocity, v*(p, t), can be computed from historical conditions at a particular data-capture location, p, and time, t. Specifically, the threshold traffic-flow velocity, v*(p, t) may then be calculated as an average (e.g., a measure of central tendency, such as a mean or median) of the traffic-flow velocity for each detector location at a particular time over a number of days using the formula for calculating the flow-averaged velocities noted above. In some implementations, the calculated average is then weighted by a value between zero and one to provide the final threshold velocity value. For example, the threshold velocity can be computed at five minute intervals and separately for each day of the week, such that each sensor 12-14 has two thousand sixteen threshold velocity values stored in the database 23. In one implementation, the event list and other data, such as accident reports, can be used to flag certain readings and exclude them from the computation of the threshold.

The event analysis component 26 then reviews the defined locations and times to determine where and when the system has experienced congestion. To this end, the event analysis component 26 determines a spatiotemporal region, defined as a set of paired sensor and time values, in which traffic is affected by the event. A given paired sensor value and time value belongs to the set if, at the time represented by the time value, the sensor detects a velocity less than a threshold value at its associated location and is part of a continuous series of sensors, including a sensor associated with the venue, in which each sensor is detecting a velocity less than its associated threshold. Or phrased differently, at a given representative time, every sensor that is part of a continuous chain of sensors registering delay and extending back to a sensor associated with the venue is added to the set with a time value equal to the representative time.

In one implementation, the event analysis component 26 represents the sensor locations as a directed acyclic graph, with each sensor representing a node in the graph. One or more sensors associated with the location of the venue associated with the event can be selected as root nodes for the directed acyclic graph, and the event detection system can explore each edge from the root node until a node is detected that does not exhibit a reduced velocity relative to the threshold. For example, one or more nodes representing the venue can be selected according to their proximity to the venue or one or major highways associated with the venue. The search continues until all edges have been fully explored or terminated on nodes that do not exhibit a reduced velocity. The search can be repeated for each of a plurality of representative times.

Figure 3:
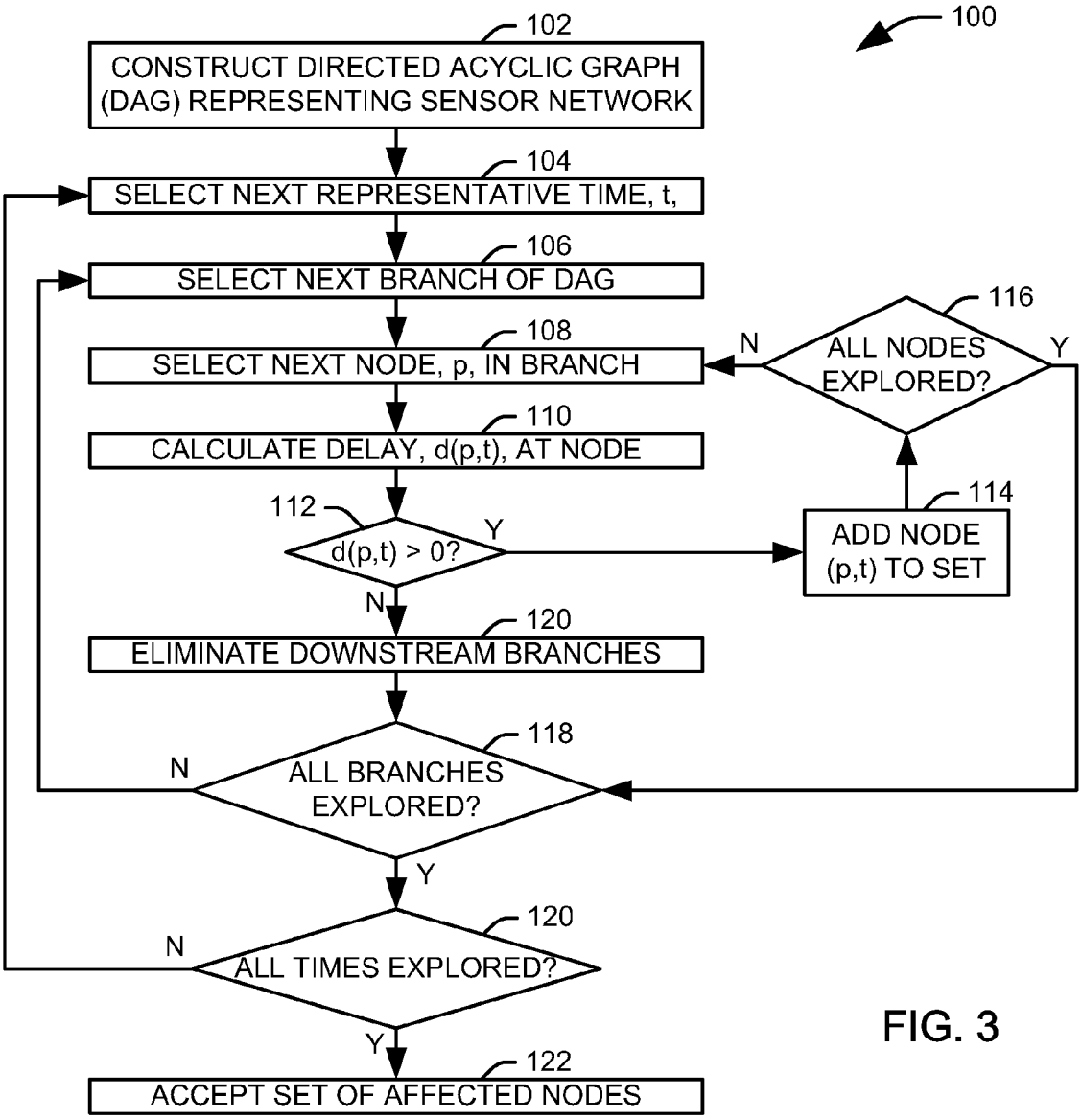
FIG. 3 illustrates one method for determining a spatiotemporal impact of a planned event from measured traffic velocities.
Figure 2:
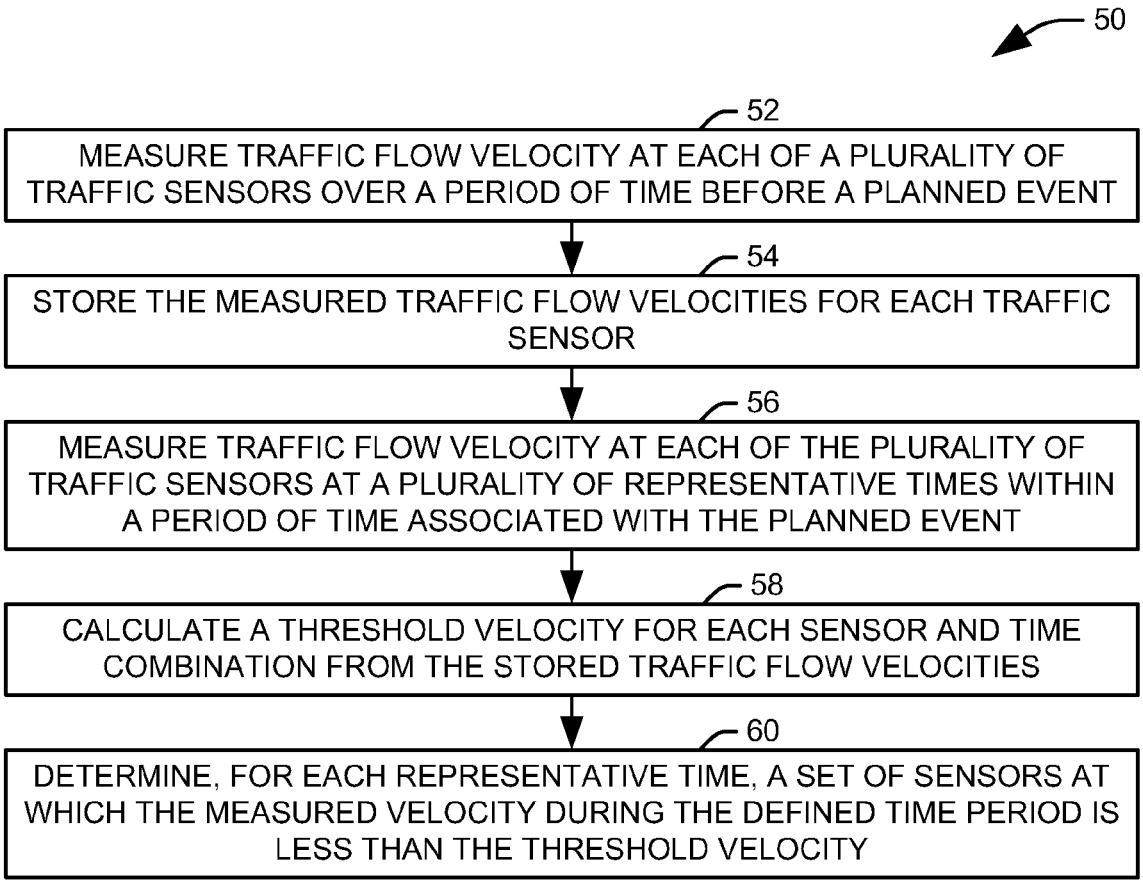
FIG. 2 illustrates an example method for determining a spatiotemporal impact of a planned event.

In view of the foregoing structural and functional features described above in FIG. 1, example methodologies will be better appreciated with reference to FIGS. 2 and 3. While, for purposes of simplicity of explanation, the methodologies of FIGS. 2 and 3 are shown and described as executing serially, it is to be understood and appreciated that the present invention is not limited by the illustrated order, as some actions could in other examples occur in different orders and/or concurrently from that shown and described herein.

FIG. 2 illustrates an example method 50 for determining a spatiotemporal impact of a planned event. At 52, traffic flow velocity is measured at each of a plurality of traffic sensors over a period of time before the planned event, with each traffic sensor having an associated geographical location. In one implementation, less than all available traffic sensors are used to determine the impact of the event. In this example, a geographical location of a venue associated with the planned event and the plurality of traffic sensors are selected from the set of available traffic sensors as those traffic sensors within a threshold distance of the geographical location of the venue. At 54, a plurality of measured traffic flow velocities for each traffic sensor are stored on a non-transitory computer readable medium.

At 56, a traffic flow velocity is measured at each traffic sensor at each of a plurality of representative times with a defined time period including a known start time and an expected end time of the event. In one implementation, the time period is defined to extend from a first time prior to the known start time to a second time after the expected end time, with the plurality of representative times selected at evenly spaced intervals within the defined time period.

At 58, a threshold velocity is calculated from the stored traffic flow velocities for each traffic sensor corresponding to each of the plurality of representative times. For example, the calculation of the threshold velocity can include calculating an average, such as a median or a mean, of the stored traffic velocities associated with a given representative time for each traffic sensor. The average can be taken at the representative time on days prior to the planned event to account for time-dependent changes in traffic patterns. In one implementation, the average can be over velocities measures at the representative time on a specific weekday corresponding to the day of the week for which the event is scheduled. The calculated average can then be multiplied by a weight between zero and one, depending on the specific implementation.

At 60, a set of traffic sensors at which the measured traffic flow velocity during the defined time period is less than the threshold velocity is determined for each of the plurality of representative times. Essentially, the sensors are evaluated for each time to provide a set of sensor/time pairs representing the spatiotemporal impact of the planned event. For example, a directed acyclic graph can be constructed comprising a plurality of nodes representing the plurality of traffic sensors. One or more traffic sensors associated with a venue of the planned event can be assigned as root nodes. The directed acyclic graph is explored for each of the plurality of representative times to determine a set of nodes representing the set of traffic sensors at which the current velocity is less than the threshold velocity at each representative time. Specifically, a node of the plurality of nodes can be selected and the measured traffic flow during the defined time period at the traffic sensor associated with the selected node at the representative time can be compared with the threshold velocity for the traffic sensor for the representative time. The traffic sensor represented by the selected node is added to the set of traffic sensors representing the impact of the planned event at the representative time if the measured traffic flow during the defined time period is less than the threshold velocity. If the measured traffic flow during the defined time period is not less than the threshold velocity, however, all nodes downstream of the selected node are eliminated from further analysis. One example of this search process is described in further detail in FIG. 3.

The graph can also be explored through a number of times to determine how the impact of the event varies with time. In one example, the start time of the event is select-ed, and the directed acyclic graph is explored for the start time of the event. The system then iteratively selects the representative time immediately before the selected time and explores the directed acyclic graph at the selected time until either no delay is found at the root node(s) of the directed acyclic graph or all representative times prior to the start time have been selected. The same process can be carried out moving forward from the start time, with the system iteratively selecting the representative time immediately after a currently selected time and exploring the directed acyclic graph at the selected time until either no delay is found at the root node(s) of the directed acyclic graph or all representative times between the start time and the end time have been selected. Finally, the expected end time of the event is selected, and the directed acyclic graph is explored for the end time of the event. The system then iteratively selects the representative time immediately after the selected time and explores the directed acyclic graph at the selected time until either no delay is found at the root node(s) of the directed acyclic graph or all representative times after the expected end time have been selected.

FIG. 3 illustrates one method 100 for determining a spatiotemporal impact of a planned event from measured traffic velocities. At 102, a directed acyclic graph is generated to represent a network of traffic sensors. Each node of the directed acyclic graph represents one traffic sensor location within a threshold geographical distance of a venue of the planned event. One or more root nodes of the graph can represent with one or more sensors associated with the venue. Series of connected nodes, referred to herein as edges, can extend from the root node or another, downstream node. Since the structure of the graph is static over time, a plurality of edges of the directed acyclic graph can be identified. To better describe the structure of a given directed acyclic graph, an edge having a starting node that is farther from the root node than a given node, that is, to trace the graph from the root node to the point of the edge requires passing through the node, is said to be downstream of the node.

At 104, a next representative time, represented here as "t", is selected for analysis from a plurality of representative times in a defined time period. In the illustrated example, the defined time period extends from a first time that is a predetermined period before the known start time of the planned event to a second time that is a predetermined period after the expected end time of the planned event. Representative times can be selected at regular intervals throughout the defined time period, such as five minutes. In one implementation, the process proceeds backwards from the start time testing progressively earlier representative times until an earliest representative time is reached or a time is found where no delay is detected at a root node of the directed acyclic graph. The process can then be performed from the start time forward until the expected end time is reached or a time is found where no delay is detected at a root node of the directed acyclic graph, and then from the expected end time forward until a latest representative time is reached or a time is found where no delay is detected at a root node of the directed acyclic graph. It will be appreciated, however, that the various times can be explored in any order.

At 106, a next edge of the directed acyclic graph is selected. In the illustrated implementation, the edges are selected such that edges closer to the root node are selected before downstream edges, although it will be appreciated that the edges can be selected in any order. At 108, a next node, represented here as "p", of the edge is selected. By a next node of the edge, it is meant that the unexplored node closest to a starting point of the edge, and thus, closest to the root node, is selected.

At 110, a delay, d(p,t), of traffic at the sensor represented by the selected node is determined at the representative time. To this end, a threshold velocity, $\bar{v}(p, t)$, can be retrieved as an average of the traffic-flow velocity for the sensor location at the representative time over a number of days multiplied by a user-selected weight. This average can be specific to the time and day of the week. For example, the threshold velocity might represent an average traffic flow at a particular location at 5:35 PM over the past thirty Mondays. The weight can be any user-selected value between zero and one, and will be selected according to a particular application. The measured traffic-flow velocity, v(p, t) and flow rate, q(t, p), in vehicles per hour, during the representative time can also be retrieved, with the delay associated with the node calculated as:

$$d(p, t) = l * q(p, t) * \left(\frac{1}{v(p, t)} - \frac{1}{\bar{v}(p, t)}\right) \quad \text{Eq. 2}$$

where l is a geographical distance between the node and an adjacent, upstream node.

At 112, it is determined if the delay at the node is greater than zero. It will be appreciated that the delay will be positive only when the measured velocity, v(p,t), is less than the threshold velocity, $\bar{v}(p,t)$. If the calculated delay is greater than zero (Y), the node, p, at time, t, is added to the solution set representing the spatiotemporal impact of the planned event at 114. It is then determined at 116 if all of the nodes in the edge have been explored. If not (N), the method returns to 108 to select a next node in the edge. If all of the nodes in the edge have been explored (Y), the method advances to 118.

Returning to the decision at 112, if the calculated delay is less than or equal to zero (N), the method advances to 120, where all edges that are downstream of the node are eliminated from further consideration at the selected representative time. Essentially, if it is necessary to pass through a node having no delay at a given representative time to reach the starting node of an edge, the edge is not explored for that time. This is in accordance with our definition of the spatiotemporal impact of the planned event provided above, in which only nodes that are part of an unbroken series of reduced velocity extending back to the venue are considered to be representative of the impact of the event.

The method then advances to 118, where it is determined if all of the edges associated with the directed acyclic graph have been eliminated or explored. If not (N), the method returns to 106 to select a new edge to explore. If all edges for a given representative time have been explored (Y), the method advances to 120, where it is determined if all of the representative times within the defined time period have been explored. If not (N), the method returns to 104 to select a new representative time for analysis. Once all of the representative times within the defined time period have been explored (Y), the method advances to 122, where the set of node/time pairs (p, t) exhibiting delay (from 114) are accepted as representing the spatiotemporal impact of the planned event.

Figure 4:
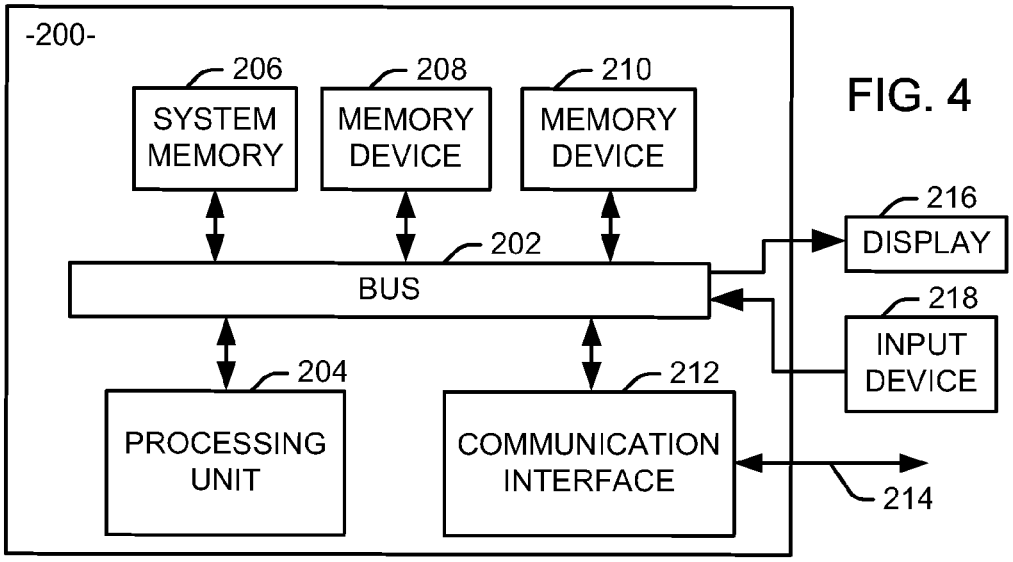
FIG. 4 illustrates an example of a computer system that can be used in conjunction with the systems and methods illustrated in FIGS. 1-3.

FIG. 4 is a schematic block diagram illustrating an exemplary system 200 of hardware components capable of implementing examples of the present disclosed in FIGS. 1-3, such as the traffic monitoring system illustrated in FIG. 1. The system 200 can include various systems and subsystems. The system 200 can be a personal computer, a laptop computer, a workstation, a computer system, an appliance, an application-specific integrated circuit (ASIC), a server, a server blade center, a server farm, etc.

The system 200 can includes a system bus 202, a processing unit 204, a system memory 206, memory devices 208 and 210, a communication interface 212 (e.g., a network interface), a communication link 214, a display 216 (e.g., a video screen), and an input device 218 (e.g., a keyboard and/or a mouse). The system bus 202 can be in communication with the processing unit 204 and the system memory 206. The additional memory devices 208 and 210, such as a hard disk drive, server, stand alone database, or other non-volatile memory, can also be in communication with the system bus 202. The system bus 202 interconnects the processing unit 204, the memory devices 206-210, the communication interface 212, the display 216, and the input device 218. In some examples, the system bus 202 also interconnects an additional port (not shown), such as a universal serial bus (USB) port.

The processing unit 204 can be a computing device and can include an application-specific integrated circuit (ASIC). The processing unit 204 executes a set of instructions to implement the operations of examples disclosed herein. The processing unit can include a processing core.

The additional memory devices 206, 208 and 210 can store data, programs, instructions, database queries in text or compiled form, and any other information that can be needed to operate a computer. The memories 206, 208 and 210 can be implemented as computer-readable media (integrated or removable) such as a memory card, disk drive, compact disk (CD), or server accessible over a network. In certain examples, the memories 206, 208 and 210 can comprise text, images, video, and/or audio, portions of which can be available in different human.

Additionally, the memory devices 208 and 210 can serve as databases or data storage such as the database 23 illustrated in FIG. 1. Additionally or alternatively, the system 200 can access an external data source through the communication interface 212, which can communicate with the system bus 202 and the communication link 214.

In operation, the system 200 can be used to implement a control system for a traffic monitoring system that determines the spatiotemporal impact of an event having a known start time and end time. Computer executable logic for implementing the traffic monitoring system resides on one or more of the system memory 206, and the memory devices 208, 210 in accordance with certain examples. The processing unit 204 executes one or more computer executable instructions originating from the system memory 206 and the memory devices 208 and 210. The term "computer readable medium" as used herein refers to a medium that participates in providing instructions to the processing unit 204 for execution, and can include multiple physical memory components linked to the processor via appropriate data connections.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the scope of the appended claims.

What is claimed is:

1. A traffic monitoring system comprising:

a plurality of sensors to generate traffic data representing traffic flow at respective geographical locations; and a system control comprising:

a processor configured to execute machine readable instructions from a non-transitory computer readable medium;

a sensor interface to receive information from the plurality of sensors;

a database to store historical data from the plurality of sensors and information about a planned event having a known start time, an expected end time, and a venue; and an event analysis component that interacts with the processor and is configured to determine a spatiotemporal region, defined as a set of paired sensor and time values, in which traffic is affected by the planned event, a given paired sensor value and time value belonging to the set if, at the time represented by the time value, the sensor detects a delay at its associated location and is part of a continuous series of sensors, including a sensor associated with the venue, in which each sensor is detecting a delay, wherein the event analysis component is configured to generate a directed acyclic graph representing a subset of the plurality of sensors within a threshold distance of the venue.

2. The traffic monitoring system of claim 1, wherein the event analysis component is configured to search the directed acyclic graph at each of a plurality of times within a defined time period to determine the spatiotemporal region.

3. The traffic monitoring system of claim 2, wherein the defined time period encompasses a predetermined period of time before the known start time of the planned event, an expected duration of the planned event, and a predetermined period after the expected end time of the planned event, the plurality of times being evenly spaced within the defined time period.

4. The traffic monitoring system of claim 1, wherein the event analysis component is configured to compute a threshold velocity from the stored historical data and determines if a given sensor detects a delay by comparing a current traffic flow velocity to the threshold velocity.

5. A method to determine an impact of a planned event comprising:

measuring traffic flow velocity at each of a plurality of traffic sensors over a period of time before the planned event, each traffic sensor having an associated geographical location;

storing a plurality of measured traffic flow velocities for each traffic sensor on a non-transitory computer readable medium;

measuring a traffic flow velocity at each traffic sensor at each of a plurality of representative times within a defined time period including a known start time and an expected end time of the planned event;

calculating a threshold velocity from the stored traffic flow velocities for each traffic sensor corresponding to each of the plurality of representative times;

determining, for each of the plurality of representative times, a set of traffic sensors at which the measured traffic flow velocity during the defined time period is less than the threshold velocity; and constructing a directed acyclic graph comprising a plurality of nodes representing the plurality of traffic sensors, with a traffic sensor associated with a venue of the planned event being a root node, wherein the directed acyclic graph is utilized by a processor to determine the impact of the planned event.

6. The method of claim 5, wherein calculating a threshold velocity from the stored traffic flow velocities comprises calculating an average, comprising one of a median and a mean, of the stored traffic velocities associated with a given representative time for each traffic sensor.

7. The method of claim 6, wherein calculating a threshold velocity from the stored traffic flow velocities further comprises multiplying the calculated average by a weight, the weight being a value between zero and one.

8. The method of claim 5, further comprising:

retrieving a geographical location of a venue associated with the planned event; and selecting the plurality of traffic sensors from a set of available traffic sensors as all traffic sensors within a threshold distance of the geographical location of the venue.

9. The method of claim 5, further comprising:

defining the defined time period such that the time period extends from a first time prior to the known start time to a second time after the expected end time; and selecting the plurality of representative times at evenly spaced intervals within the defined time period.

10. The method of claim 5, wherein determining, for each of the plurality of representative times, a set of traffic sensors at which the current velocity is less than the threshold velocity comprises exploring the directed acyclic graph for each of the plurality of representative times to determine a set of nodes representing the set of traffic sensors at which the current velocity is less than the threshold velocity.

11. The method of claim 10, wherein exploring the directed acyclic graph for each of the plurality of representative times comprises:

selecting a node of the plurality of nodes;

comparing the measured traffic flow during the defined time period at the traffic sensor associated with the selected node at the representative time with the threshold velocity for the traffic sensor for the representative time;

adding the traffic sensor represented by the selected node to the set of traffic sensors if the measured traffic flow during the defined time period is less than the threshold velocity; and eliminating all nodes downstream of the selected node from further analysis if the measured traffic flow during the defined time period is not less than the threshold velocity.

12. The method of claim 10, wherein exploring the directed acyclic graph for each of the plurality of representative times comprises:

selecting the start time of the planned event;

exploring the directed acyclic graph for the start time of the planned event; and iteratively repeating the following steps until either no delay is found at the root node of the directed acyclic graph or all representative times prior to the start time have been selected:

selecting a representative time immediately before a currently selected time; and exploring the directed acyclic graph for the selected time.

13. The method of claim 12, wherein exploring the directed acyclic graph for each of the plurality of representative times further comprises:

selecting the end time of the planned event;

exploring the directed acyclic graph for the end time of the planned event; and iteratively repeating the following steps until either no delay is found at the root node of the directed acyclic graph for a selected time or all representative times after the end time have been selected:

selecting a representative time immediately after a currently selected time; and exploring the directed acyclic graph for the selected time.

14. A traffic monitoring system comprising:

a plurality of sensors to generate traffic data representing traffic flow at respective geographical locations; and a system control comprising:

a processor configured to execute machine readable instructions from a non-transitory computer readable medium;

a sensor interface to receive information from the plurality of sensors;

a database to store historical data from the plurality of sensors and information about a planned event having a known start time, an expected end time, and a venue; and an event analysis component that interacts with the processor and is configured to determine a spatiotemporal region, defined as a set of paired sensor and time values, in which traffic is affected by the planned event, a given paired sensor value and time value belonging to the set if, at the time represented by the time value, the sensor detects a delay at its associated location and is part of a continuous series of sensors, including a sensor associated with the venue, in which each sensor is detecting a delay, by generating a directed acyclic graph representing a subset of the plurality of sensors within a threshold distance of the venue and searching the directed acyclic graph at each of a plurality of times within a defined time period encompassing a predetermined period of time before the known start time of the planned event, an expected duration of the planned event, and a predetermined period after the expected end time of the planned event to determine the spatiotemporal region.

* * * * *